US005865567A

United States Patent [19]

Wilkinson

[11] Patent Number: 5,865,567

[45] Date of Patent: Feb. 2, 1999

[54] MOVABLE TRENCH SHORING DEVICE

[76] Inventor: Ivan R. Wilkinson, 5457 W. Black Canyon Rd., Emmett, Id. 83617

[21] Appl. No.: 759,976

[22] Filed: Dec. 3, 1996

[51] Int. Cl.[6] ..... E02D 17/08

[52] U.S. Cl. ..... 405/283; 405/282

[58] Field of Search ..... 405/272, 273, 405/282, 283

[56] References Cited

U.S. PATENT DOCUMENTS

| | | | |
|---|---|---|---|
| 3,788,086 | 1/1974 | West, Jr. | 405/283 |
| 4,874,271 | 10/1989 | Arnold | 405/283 |
| 5,306,103 | 4/1994 | Spencer | 405/282 X |

*Primary Examiner*—Tamara L. Graysay
*Assistant Examiner*—Tara L. Mayo
*Attorney, Agent, or Firm*—Joseph W. Holland

[57] ABSTRACT

An improved movable trench shoring device having a trench box depending from a frame, the frame including a pair of end frame members, a pair of side frame members and a pair of cross frame members. A pair of wheel assemblies are mounted along either of the two sides of the device allowing the device to be rolled along the ground. Each end frame members are configured to accommodate a removable frame member extension which allows the width of the trench shoring device's wheel base to be widened. A trench box depends below the frame from a pair of vertical support members. A pair of offset spreader couplings attached to the trench box spreaders accommodate attachment of the trench box to the vertical support members in a manner which allows the trench box to be raised substantially above the elevation of the frame.

21 Claims, 4 Drawing Sheets

MOVABLE TRENCH SHORING DEVICE

BACKGROUND OF THE INVENTION

1. Technical Field

The present invention relates generally to devices for trench shoring and, more specifically, to a device that may be readily positioned and moved along a length of trench, for shoring the trench.

2. Background

Trench shoring is used to secure the sides of ditches and trenches which may be occupied by laborers during operations which may occur at the bottom of the trench, oftentimes in utility construction and maintenance. Trench shoring typically consists of two opposing panels which are held in spaced apart relationship by a plurality of struts or spreaders which may be of a fixed and interchangeable length or in the alternative adjustable in length, thereby adjusting the distance between the spaced apart panels for any given width of ditch.

Once the trench is opened by excavation, the shoring or trench box is set into the trench. Laborers may then enter the trench and work at the bottom in a far safer environment than that which would exist in an open trench. As the trenching advances, additional trench boxes may be placed along the trench or, alternatively, a trench box may be advanced along the length of the trench as it advances with the work. In this case, the box is typically lifted by the hoe or shovel which is performing the excavation and advanced along the length of the trench and then dropped or placed into the trench.

A number of disadvantages are present with this arrangement, including the fact that the trench boxes typically set at the bottom of the ditch which reduces the clearance between the lower spreaders and the work which is being performed at the bottom of the trench. Additionally, moving the trench box or advancing the box along the trench is a cumbersome and time consuming operation.

A number of solutions have been suggested to address these and other disadvantages. West Jr., U.S. Pat. No. 3,788,086, discloses a trench barrier having a horizontal frame carriage with wheels mounted on the ends of the frame carriage. The West carriage has suspended from it a pair of spaced apart shield members which may be held in spaced apart relation by jacks extending between the shield members. West also discloses vertically disclosed cooperating telescoping struts which are carried by the carriage for adjusting the relative vertical position of the shield members, and allows for varying the height at which the shield members are suspended in the trench. However, as shown in the West disclosure, the wall members extend well past the ends of the frame carriage and the axles, thereby restricting vertical movement of the wall members to a height determined by the elevation of the frame carriage and the axles.

Arnold, U.S. Pat. No. 4,874,271, discloses a trench shoring machine having a main frame having a pair of substantially vertical guide members carried by the main frame, a pair of transversely extending carrier bars engage the pair of vertical guide members, and opposed shoring plates supported from the carrier bars which are moveable along the length of the carrier bars. Arnold further discloses a pair of shoring plates, including a top plate and a lower plate, which are movable between relatively upper and lower positions with respect to the main frame, together with means for moving the lower plate between an upper and lower position.

The Arnold device allows the shoring plates to be raised above the elevation of the axles, but accomplishes this through a configuration wherein the main frame is suspended substantially above the axles through the use of a triangular carrier frame located at each wheel. This configuration results in placement of the substantial weight of the main frame well above the axles. This configuration results in a raised center of gravity for the apparatus. During operations, which typically occur along an open trench having excavation tailings piled along either side of the trench, the heightened center of gravity may cause a propensity in the apparatus to overturn.

In Spencer, U.S. Pat. No. 5,306,103, a carriage assembly is disclosed which supports a trench box in a suspended relationship having a pair of axles, a pair of spaced apart bracket elements disposed on each axle, a pair of wheel assemblies disposed at opposite ends of each axle and a support member attached to each of the bracket elements in a downwardly depending relation thereto, the support member being connected to the trench box.

In Spencer, a support member extends for a portion of its length through a rigidifying member located near the outer edges of each of the two trench shields. The overall configuration of the Spencer apparatus results in a fairly rigid structure which may be suitable for lightweight panels, fabricated of aluminum for instance, and panels of a limited height and depth. However such a rigid configuration is unsuitable for use with large steel panels used in many applications. Once again, vertical travel of the trench box is limited by the elevation of the frame and axles.

What is needed is an improved movable trench shoring device, for use with large steel trench shoring boxes, which is capable of supporting boxes which may reinforce and support trench banks as deep as 25–30 feet with shoring panels as wide as 36 feet. What is also needed is a portable or moveable trench shoring device which also provides a support means for the shoring box which allows for adjustment of the height of the shoring box or panels relative to the frame so that the top edge of the panel shoring box or panels may be adjusted above the elevation of the frame, thereby providing increased flexibility in the working dimensions of the device so that it may accommodate a variety of ditch depths without having to interchange larger panels for shorter panels. Additionally, it would be advantageous to have a device for shoring trenches which is moveable or portable and which allows for variation of the wheel base width. Additional objects, advantages and novel features of the invention will be set forth as part of the description that follows and, in part, will become apparent to those skilled in the art upon examination of the following or may be learned by practice of the invention.

SUMMARY OF THE INVENTION

According to the present invention, these and other objects are achieved by an improved movable trench shoring device for movement along a surface adjacent to the trench including a frame having a pair of side frame members and a pair of end frame members. The frame may include additional cross members attached at either of their two ends and spanning between the end frame members. The cross members may be attached permanently or removably to the end frame members.

The frame has an elevation defined by the distance from the surface upon which the device is positioned to the bottom of the frame. Suspendable from the frame is a trench box having a pair of opposing panels and a plurality of spreaders for maintaining the relative distance between the trench box panels.

The frame is supported by four wheel assemblies, one wheel assembly located near each of the four corners of the frame. In the preferred embodiment each wheel assembly consists of a wheel or caster capable of rotating 360 degrees, thereby allowing a wide range of mobility of the device.

In the preferred embodiment, each of the two end frame members are formed of a tubular member having an opening at either end which allows for placement of a frame member extension within each of the end frame members thereby allowing adaptation of the device to include an even wider wheel base where conditions permit or otherwise dictate that additional stability for the device might be required.

Another important feature of the invention is the means by which the trench box may be suspended from the frame. A pair of vertical support members depend from the frame, a first vertical support member depending from a first cross member spanner and a second vertical support member depending from a second cross member spanner. The pair of cross member spanners are adjustable in a horizontal plane along the length of the frame cross members allowing movement of the cross member spanners to accommodate a variety of box length configurations.

Located at the second end of each vertical support member is an offset spreader coupling. One offset spreader coupling is attached to one of two opposite trench box spreaders and the remaining offset spreader coupling is attached to the opposite trench box spreader. By opposite I mean located near opposite ends of the length of the trench box.

A first vertical support member slideably engages a first cross member spanner near its first end and depends from the cross member spanner. The second end of the vertical support member slideably engages a first offset spreader couplings near its second end. Similarly, a second vertical support member slideably engages the second cross member spanner near the first end of the vertical support member. The second end of the vertical support member slideably engages the second offset spreader coupling. Each of the offset spreader couplings includes a pair of collars attached to one another by an extension and held in spaced apart relation to one another at a ninety degree offset to one another. This configuration of the offset spreader couplings allows the trench box to be raised above the elevation of the frame.

The height of the trench box may be varied by sliding the vertical support members through the offset couplings to the desired elevation. The trench box is fixed in position by pins which are inserted through a set of corresponding holes in the vertical support members and the offset couplings. Additional vertical adjustment of the trench box elevation relative to the frame is accomplished by sliding the vertical support members through the cross member spanners and fixing in position by pins which are inserted through a set of corresponding holes in the vertical support members and the cross member spanners.

The disclosed configuration allows the trench box to be raised or lifted between the elements of the frame permitting a broad range of height configurations for the improved movable trench shoring device including height configurations wherein the top of the trench box is raised above the elevation of the frame. In addition, the disclosed configuration provides a flexible connection between the frame and the trench box substantially reducing the risk of bending or breaking the various structural elements of the device.

In addition, the degree of freedom of movement between the various components of the frame, the vertical support means and the offset spreader couplings permits the device to adapt to a variety of trench configurations without binding within the trench during operations and while advancing the device in the trench, thereby substantially reducing the risk of damage to the device and its various component parts.

Additional objects, advantages and novel features of the invention will be set forth in part in the description that follows, and in part will become apparent to those skilled in the art upon examination of the following or may be learned by practice of the invention.

DETAILED DESCRIPTION OF THE INVENTION

Figure 1:
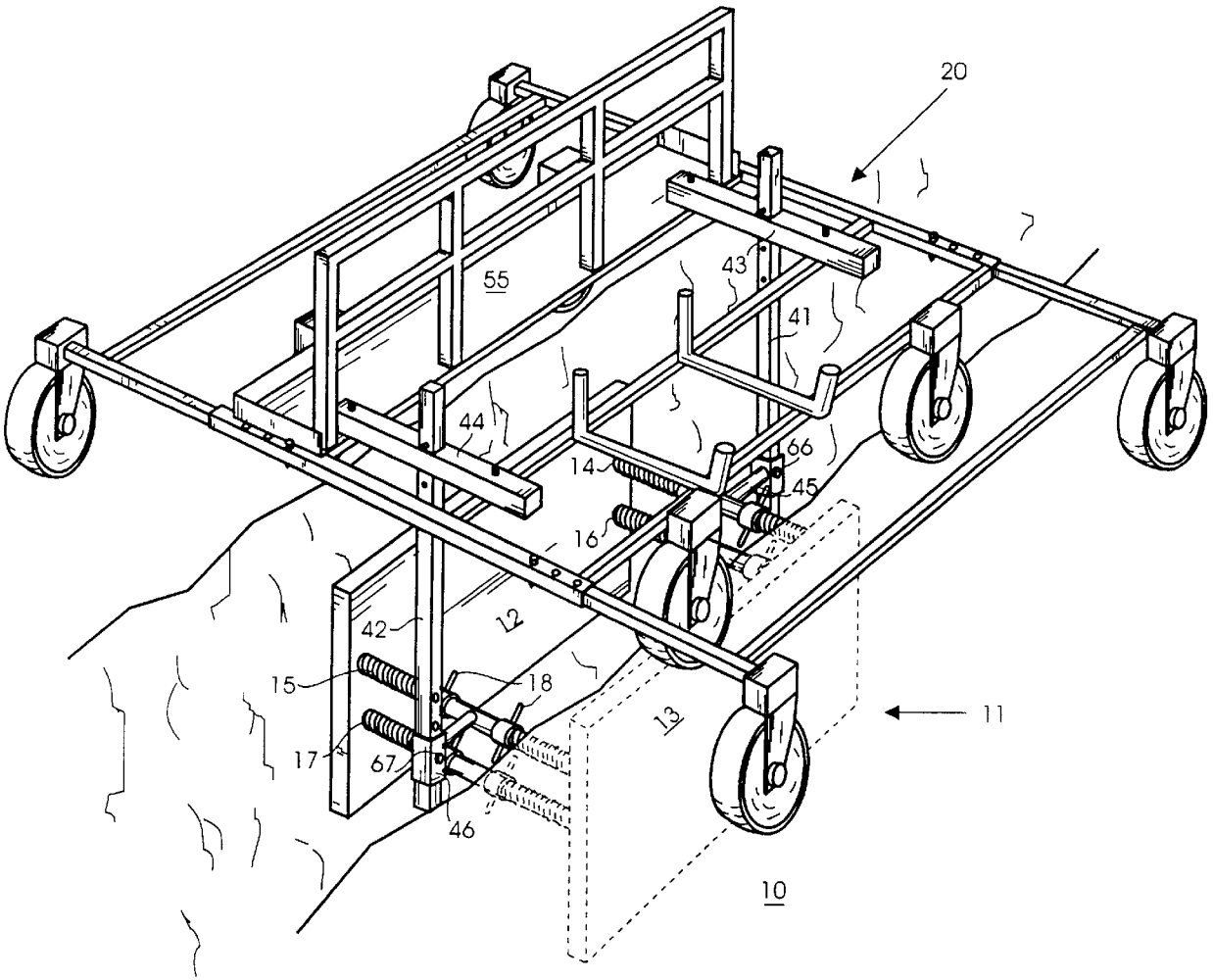
FIG. 1 is a perspective representational view of the improved movable trench shoring device.
Figure 2:
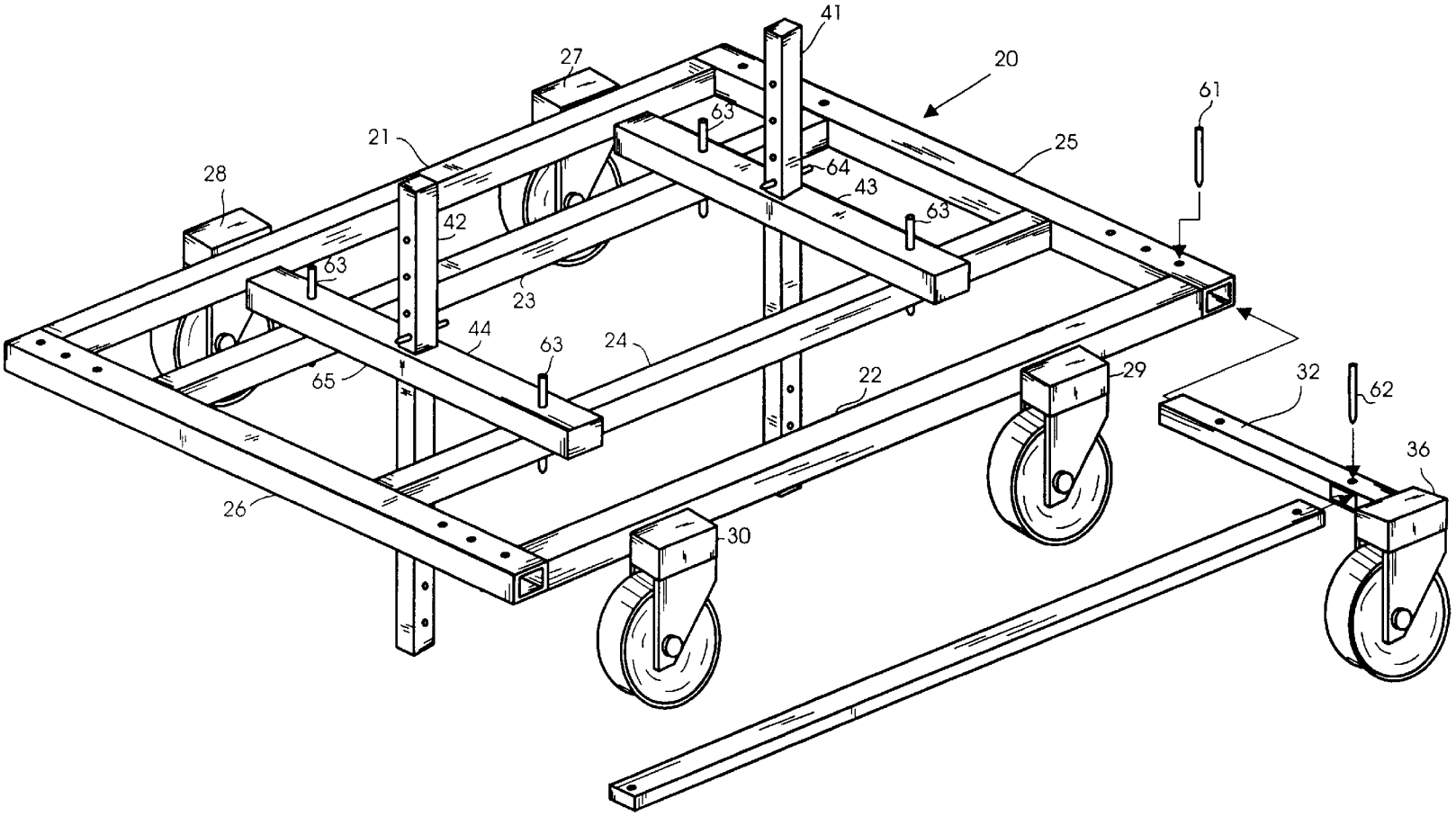
FIG. 2 is an exploded representational view of various frame components of the improved movable trench shoring device.

Referring now to FIGS. 1 through 4, the improved movable trench shoring device 10 will be more fully described and understood. FIG. 2 is an exploded representational view of various frame components of the improved movable trench shoring device showing frame 20 including first side frame member 21 and second side frame member 22 spanning between and attached at either of their two ends to first end frame member 25 and second end frame member 26.

The preferred embodiment of the invention also includes first cross frame member 23 and second cross frame member 24 spanning between and removably attached at either of their two ends to first end frame member 25 and second end frame member 26. Means for positively engaging the cross frame members and the associated end frame members include pins or bolt and nut assemblies which pass through corresponding holes located in the cross frame members and the associated end frame members to secure the crossframe members to the end frame members. Specifically, as shown in FIG. 2, the first and second ends of first cross frame member 23 are held in position using pins 68 which pass through a hole located at either of the two ends of first cross frame member 23 and corresponding holes located in first end frame member 25 and second end frame member 26. Similarly, the first and second ends of second cross frame member 24 are held in position using pins 68 which pass through a hole located at either of the two ends of first cross frame member 23 and corresponding holes located in first end frame member 25 and second end frame member 26. This feature allows the distance between first cross frame member 23 and second cross frame member 24 to be varied to accommodate a variety of trench box widths.

Frame 20 is supported by and movable on first wheel assembly 27, second wheel assembly 28, third wheel assembly 29 and fourth wheel assembly 30 all of which are attached to frame 20 specifically to first side frame member 21 and second side frame member 22.

Figure 3:
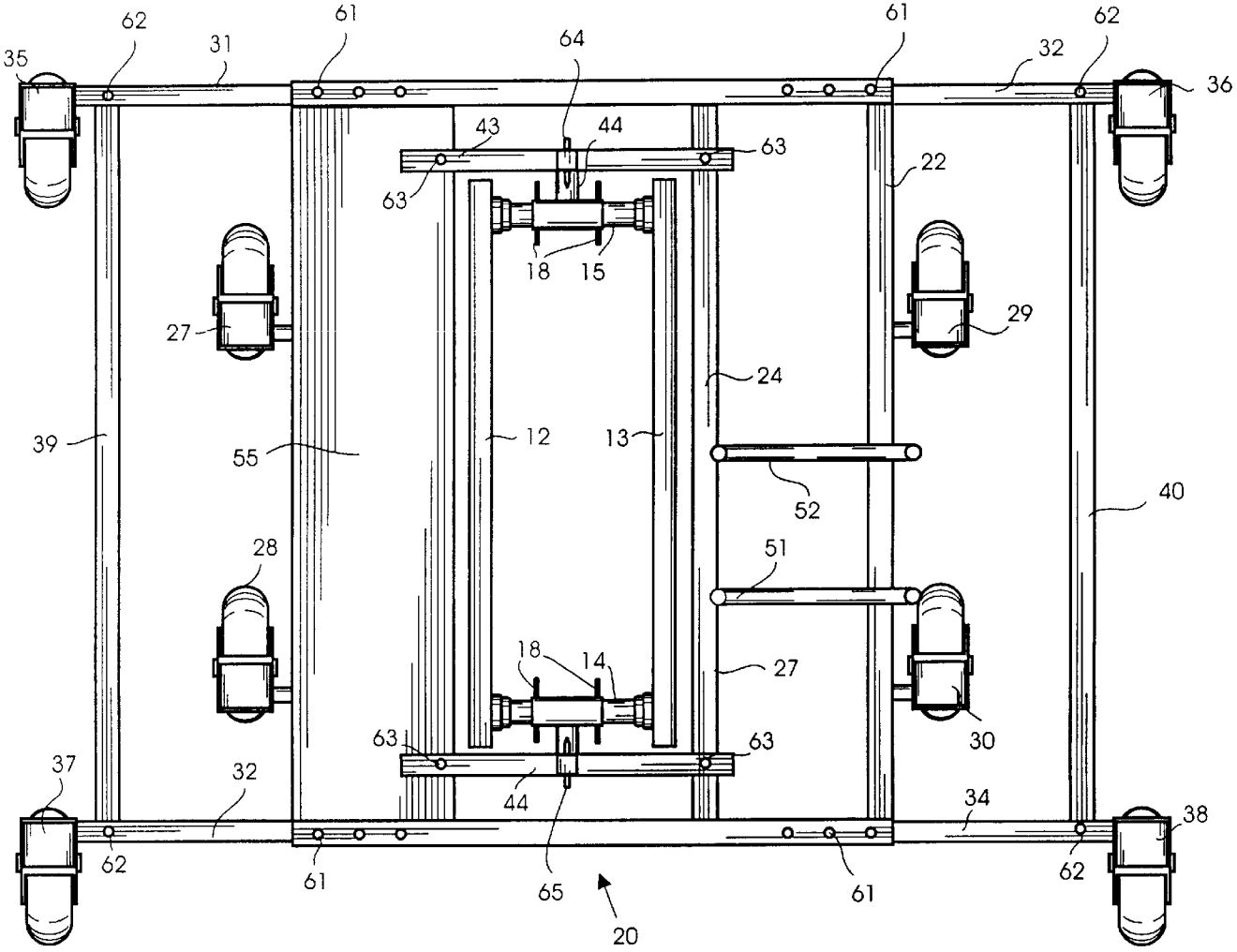
FIG. 3 is a top representational view of the improved movable trench shoring device.
Figure 4:
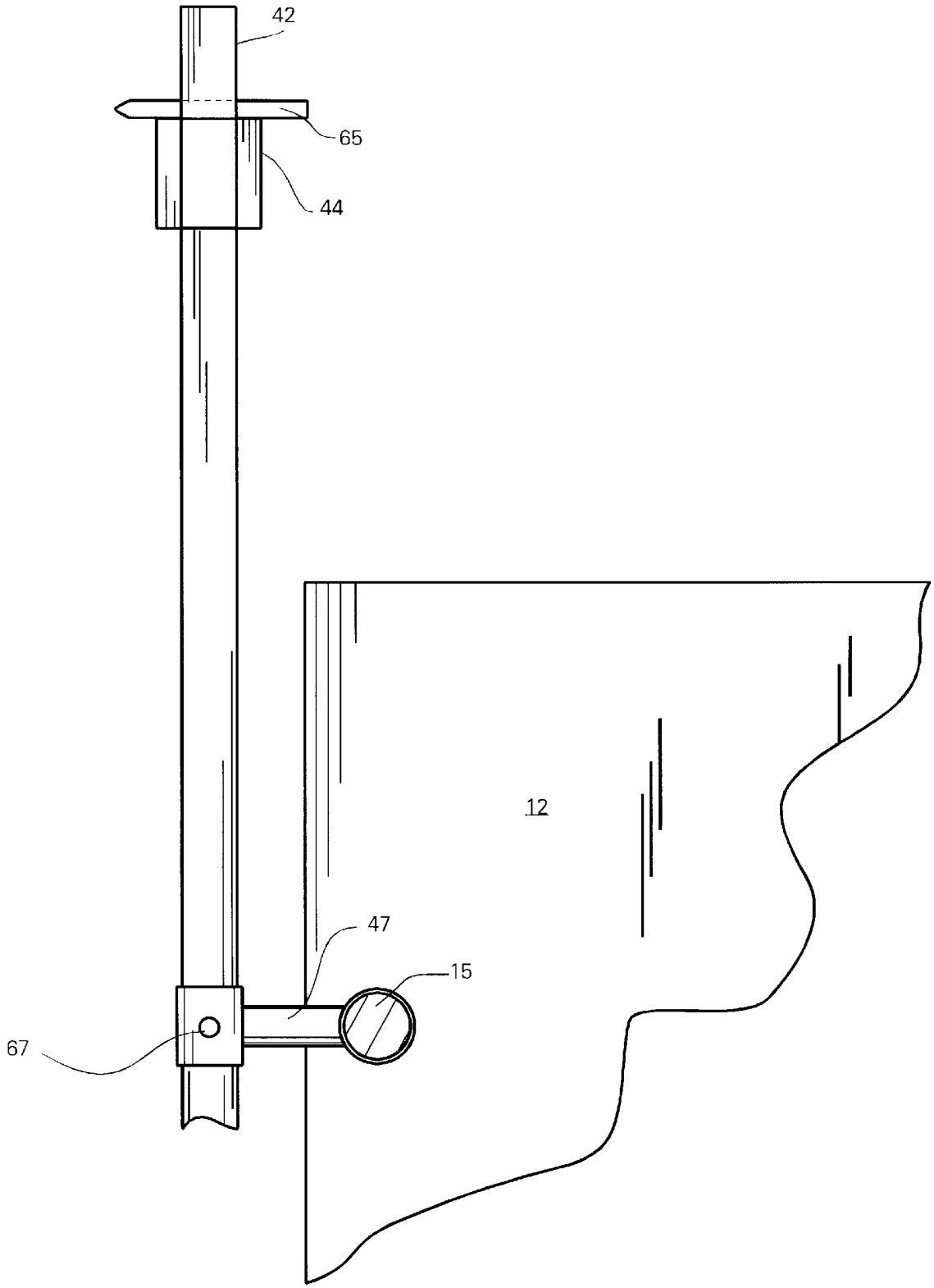
FIG. 4. is a detail of the improved movable trench shoring device box showing the vertical support member, a cross member spreader and an offset spreader coupling.

In the preferred embodiment first end frame member 25 and second end frame member 26 are formed of tubular members having an opening at either end. Referring to FIG. 3, first end frame member first extension 31 slideably engages and extends from the first end of first end frame member 25 and first end frame member second extension 32 slideably engages and extends from the second end of first end frame member 25. Similarly, second end frame member first extension 33 slideably engages and extends from the first end of second end frame member 26 and second end frame member second extension 34 slideably engages and extends from the second end of second end frame member 26. Means for positively engaging the end frame members and the associated frame member extensions include pins 61 which pass through corresponding holes located in the end frame members and the associated frame member extensions to secure the frame member extension within the end frame member.

First end frame member first wheel assembly 35 is attached at the outer end of first end frame member first extension 31 and first end frame member second wheel assembly 36 is attached at the outer end of first end frame member second extension 32. Second end frame member first wheel assembly 37 is attached at the outer end of second end frame member first extension 33 and second end frame member second wheel assembly 38 is attached at the outer end of second end frame member second extension 34.

First wheel extension stiffener 39 spans between and is removably attached at either of its two ends to first end frame member first extension 31 and second end frame member first extension 33. Similarly, second wheel extension stiffener 40 spans between and is removably attached at either of its two ends to first end frame member second extension 32 and second end frame member second extension 34. Means for positively engaging the wheel extension stiffeners and the associated frame member extensions includes pins 62 which pass through corresponding holes located in the wheel extension stiffeners and the associated frame member extensions to secure the wheel extension stiffeners within the frame member extensions.

Referring to FIG. 1 through 4 trench box 11 is shown depending from frame 20. Trench box 11 includes first trench box panel 12 and second trench box panel 13. The relative distance between first trench box panel 12 and second trench box panel 13 is maintained using first spreader 14, second spreader 15, third spreader 16 and fourth spreader 17.

Referring to FIGS. 1 through 4, first vertical support member 41 slideably engages and depends from cross member spanner 43 near its first end. The second end of first vertical support member 41 slideably engages first vertical support offset spreader coupling 45. Similarly, second vertical support member 42 slideably engages and depends from cross member spanner 44 near its first end. The second end of second vertical support member 42 slideably engages second vertical support offset spreader coupling 46.

Means for positively engaging the cross member spanners with the cross members include pins 63 which pass through corresponding holes located in cross member spanner 43 and cross member spanner 44 and the associated first cross frame member 23 and second cross frame member 24 secure the cross member spanners from sliding along the cross members while the apparatus in use. Means for positively engaging the vertical support members with the cross member spanners include pin 64 which secures first vertical support member 41 from sliding through cross member spanner 43 and pin 66 secures second vertical support member 42 from sliding through cross member spanner 44. Means for positively engaging the vertical support members within the vertical support offset spreader couplings include pin 65 which secures first vertical support member 41 from sliding through first vertical support offset spreader coupling 45 and pin 67 which secures second vertical support member 42 from sliding through second vertical support offset spreader coupling 46.

Referring again to FIG. 1, the preferred embodiment of the invention also includes pipe laydown rack having first arm 51 and second arm 52 which provides a convenient surface for laying down a length of pipe for picking and positioning in the trench. The preferred embodiment of the invention also includes work platform 55 which provides a convenient surface for personnel assisting in work activities.

Referring to FIGS. 1 through 4, in use, movable trench shoring device 10, is positioned over an excavated trench. Trench box 11 is set into the trench by lowering between first cross frame member 23 and second cross frame member 24 and first end frame member 25 and second end frame member 26 by a power shovel or other apparatus typically conducting the excavation of the trench.

First vertical support member 41 is adjusted to the desirable position within first vertical support offset spreader coupling 45 and pin 66 is used to secure first vertical support member 41 at the desirable position within first vertical support offset spreader coupling 45. Next, second vertical support member 42 is adjusted to the desirable position within second vertical support offset spreader coupling 46 and pin 67 is used to secure second vertical support member 42 at the desirable position within second vertical support offset spreader coupling 46. Trench box 11 is raised into the desired vertical position by lifting by a power shovel or other apparatus typically conducting the excavation of the trench. Once trench box 11 has been located at the desired height, pin 64 is inserted through the corresponding holes located in first vertical support member 41 and cross member spanner 43 and pin 65 is inserted through the corresponding holes located in second vertical support member 42 and cross member spanner 44. Trench box 11 is now suspended from frame 20, with the weight of the apparatus being supported by and movable on first wheel assembly 27, second wheel assembly 28, third wheel assembly 29 and fourth wheel assembly 30.

In situations or conditions where additional support or stability for the apparatus is desired or where conditions dictate it may be desirable to increase the width of the wheel base of movable trench shoring device 10 by adding first end frame member first extension 31 with its attached first end frame member first wheel assembly 35, first end frame member second extension 32 with its attached first end frame member first wheel assembly 36, second end frame member first extension 33 with its attached first end frame member first wheel assembly 37 and second end frame member second extension 34 with its attached first end frame member first wheel assembly 38. Once positioned, the extensions are secured in position within the end frame members by inserting pins 61 into the corresponding holes located in the extensions within the end frame members. First wheel extension stiffener 39 and second wheel extension stiffener 40 are attached at either of their two ends to the frame extensions using pins 62.

To advance the device along the length of an excavated trench, the hoe, power shovel or other piece of equipment pushes or pulls the device along above the trench. Trench box 11 may be raised or lowered depending upon the elevation of the bottom of the trench and the distance which the operator wishes to observe between the bottom of trench box 11 and the bottom of the trench.

While there is shown and described the preferred embodiment of the invention, it is to be distinctly understood that this invention is not limited thereto but may be variously embodied to practice within the scope of the following claims.

I claim:

1. An improved movable trench shoring device for movement along a surface adjacent to a trench comprising:

a frame;

a plurality of wheel assemblies attached to the frame and supporting the frame;

a first vertical support member including a first end and a second end slideably engaged with and depending from the frame and having means for positively engaging the frame;

a second vertical support member including a first end and a second end slideably engaged with and depending from the frame and having means for positively engaging the frame;

a first offset spreader coupling slideably engaged with the first vertical support member near the first vertical support member second end and having means for positively engaging the first vertical support member within said first offset spreader coupling;

a second offset spreader coupling slideably engaged with the second vertical support member near the second vertical support member second end and having means for positively engaging the second vertical support member within said second offset spreader coupling; and a trench box having a first trench box panel including a first end and a second end, a second trench box panel including a first end and a second end and a first spreader including a first end and a second end and an opposing spreader including a first end and a second end, the first end of the first spreader attached near the first end of the first trench box panel, the second end of the first spreader attached near the first end of the second trench box panel and the first end of the opposing spreader attached near the second end of the first trench box panel and the second end of the opposing spreader attached near the second end of the second trench box panel for maintaining the relative distance between the trench box panels, the first offset spreader coupling being attached to the first spreader and the second offset spreader coupling attached to the opposing spreader.

2. The device of claim 1 wherein the frame further comprises:

a first side frame member and a second side frame member spanning between and attached at either of their two ends to a first end frame member and a second end frame member;

a first cross frame member and a second cross frame member spanning between and attached at either of their two ends to the first end frame member and the second end frame member; and a plurality of cross members attached at either of their two ends to the first end frame member and the second end frame member.

3. The device of claim 2 wherein the frame further comprises:

a first end frame member first extension, a first end of the first end frame member first extension slideably engaged with and extending from a first end of the first end frame member, a second end of the first end frame member first extension having a wheel assembly attached thereto;

a first end frame member second extension, a first end of the first end frame member second extension slideably engaged with and extending from a second end of the first end frame member, a second end of the first end frame member second extension having a wheel assembly attached thereto;

a second end frame member first extension slideably engaged with and extending from a first end of the second end frame member, a second end of the second end frame member first extension having a wheel assembly attached thereto;

a second end frame member second extension slideably engaged with and extending from a second end of second end frame member, a second end of the second end frame member second extension having a wheel assembly attached thereto.

4. The device of claim 3 further comprising a pair of wheel extension stiffeners, the first wheel extension stiffener spanning between and removably attached at either of its two ends to the first end frame member first extension and the second end frame member first extension and the second wheel extension stiffener spanning between and removably attached at either of its two ends to the first end frame member second extension and the second end frame member second extension.

5. The device of claim 2 wherein the plurality of cross members are all removably attached at either of their two ends to the first end frame member and the second end frame member.

6. The device of claim 1 wherein the offset spreader couplings further comprise a pair of collars attached to one another by an extension and held in spaced apart relation to one another at a ninety degree offset to one another.

7. The device of claim 1 further comprising a pipe laydown rack for laying down a length of pipe on the frame.

8. The device of claim 1 further comprising a work platform.

9. An improved movable trench shoring device for movement along a surface adjacent to a trench comprising:

a frame having a first side frame member and a second side frame member spanning between and attached at either of their two ends to a first end frame member and a second end frame member;

a first cross frame member and a second cross frame member spanning between and attached at either of their two ends to the first end frame member and the second end frame member;

a first wheel assembly and a second wheel assembly attached to the first side frame member and a third wheel assembly and a fourth wheel assembly attached to the second side frame member;

a first cross member spanner, the first end of the first cross member spanner, slideably adjustable along and attachable to the first cross frame member and the second end of the first cross member spanner, slideably adjustable along and attachable to the second cross frame member;

a second cross member spanner, the first end of the second cross member spanner, slideably adjustable along and attachable to the first cross frame member and the second end of the second cross member spanner, slideably adjustable along and attachable to the second cross frame member;

a first vertical support member including a first end and a second end slideably engaged with and depending from the first cross member spanner and having means for positively engaging the first cross member spanner;

a second vertical support member including a first end and a second end slideably engaged with and depending from the second cross member spanner and having means for positively engaging the second cross member spanner;

a first offset spreader coupling slideably engaged with the first vertical support member near the first vertical support member second end and having means for positively engaging the first vertical support member within said first offset spreader coupling;

a second offset spreader coupling slideably engaged with the second vertical support member near the second vertical support member second end and having means for positively engaging the second vertical support member within said second offset spreader coupling; and a trench box having a first trench box panel including a first end and a second end, a second trench box panel including a first end and a second end and a first spreader including a first end and a second end and an opposing spreader including a first end and a second end, the first end of the first spreader attached near the first end of the first trench box panel, the second end of the first spreader attached near the first end of the second trench box panel and the first end of the opposing spreader attached near the second end of the first trench box panel and the second end of the opposing spreader attached near the second end of the second trench box panel for maintaining the relative distance between the trench box panels, the first offset spreader coupling being attached to the first spreader and the second offset spreader coupling attached to the opposing spreader.

10. The device of claim 9 wherein the frame further comprises:

a first end frame member first extension, the first end of the first end frame member first extension slideably engaging and extending from a first end of the first end frame member, the second end of the first end frame member first extension having a wheel assembly attached thereto;

a first end frame member second extension, the first end of the first end frame member second extension slideably engaging and extending from a second end of the first end frame member, the second end of the first end frame member second extension having a wheel assembly attached thereto;

a second end frame member first extension slideably engaging and extending from a first end of the second end frame member, the second end of the second end frame member first extension having a wheel assembly attached thereto; and a second end frame member second extension slideably engaging and extending from a second end of second end frame member, the second end of the second end frame member second extension having a wheel assembly attached thereto.

11. The device of claim 10 further comprising a pair of wheel extension stiffeners, the first wheel extension stiffener spanning between and removably attached at either of its two ends to the first end frame member first extension and the second end frame member first extension and the second wheel extension stiffener spanning between and removably attached at either of its two ends to the first end frame member second extension and the second end frame member second extension.

12. The device of claim 9 wherein the offset spreader couplings further comprise a pair of collars attached to one another by an extension and held in spaced apart relation to one another at a ninety degree offset to one another.

13. The device of claim 9 wherein the plurality of cross members are removably attached at either of their two ends to the first end frame member and the second end frame member.

14. The device of claim 9 further comprising a pipe laydown rack for laying down a length of pipe on the frame.

15. The device of claim 9 further comprising a work platform.

16. An improved movable trench shoring device for movement along a surface adjacent to a trench for supporting a trench box having a first trench box panel including a first end and a second end, a second trench box panel including a first end and a second end and a first spreader including a first end and a second end and an opposing spreader including a first end and a second end, the first end of the first spreader attached near the first end of the first trench box panel, the second end of the first spreader attached near the first end of the second trench box panel and the first end of the opposing spreader attached near the second end of the first trench box panel and the second end of the opposing spreader attached near the second end of the second trench box panel for maintaining the relative distance between the trench box panels, the device comprising:

a frame;

a plurality of wheel assemblies attached to the frame and supporting the frame;

a first vertical support member including a first end and a second end slideably engaged with and depending from the frame and having means for positively engaging the frame;

a second vertical support member including a first end and a second end slideably engaged with and depending from the frame and having means for positively engaging the frame;

a first offset spreader coupling slideably engaged with the first vertical support member near the first vertical support member second end and having means for positively engaging the first vertical support member with the first offset spreader coupling, the first offset spreader coupling being attached to the first speader; and a second offset spreader coupling slideably engaged with the second vertical support member near the second vertical support member second end and having means for positively engaging the second vertical support member with the second offset spreader coupling, the second offset spreader coupling attached to the opposing spreader.

17. The device of claim 16 wherein the frame further comprises:

a first side frame member and a second side frame member spanning between and attached at either of their two ends to a first end frame member and a second end frame member;

a first cross frame member and a second cross frame member spanning between and attached at either of their two ends to the first end frame member and the second end frame member; and a plurality of cross members attached at either of their two ends to the first end frame member and the second end frame member.

18. The device of claim 17 wherein the frame further comprises:

a first end frame member first extension, the first end of the first end frame member first extension slideably engaged with and extending from a first end of the first end frame member, the second end of the first end frame member first extension having a wheel assembly attached thereto;

a first end frame member second extension, the first end of the first end frame member second extension slideably engaged with and extending from a second end of the first end frame member, the second end of the first end frame member second extension having a wheel assembly attached thereto;

a second end frame member first extension slideably engaged with and extending from a first end of the second end frame member, the second end of the second end frame member first extension having a wheel assembly attached thereto;

a second end frame member second extension slideably engaged with and extending from a second end of second end frame member, the second end of the second end frame member second extension having a wheel assembly attached thereto.

19. The device of claim 18 further comprising a pair of wheel extension stiffeners, the first wheel extension stiffener spanning between and removably attached at either of its two ends to the first end frame member first extension and the second end frame member first extension and the second wheel extension stiffener spanning between and removably attached at either of its two ends to the first end frame member second extension and the second end frame member second extension.

20. The device of claim 17 wherein the plurality of cross members are removably attached at either of their two ends to the first end frame member and the second end frame member.

21. The device of claim 16 wherein the offset spreader couplings further comprise a pair of collars attached to one another by an extension and held in spaced apart relation to one another at a ninety degree offset to one another.

* * * * *